United States Patent [19]
Kobayashi et al.
[11] 4,196,666
[45] Apr. 8, 1980

[54] PRINTING APPARATUS HAVING PRINT LINE VISIBILITY CONTROL

[75] Inventors: Tsuneki Kobayashi; Toshio Hiki; Kiyoo Kawate, all of Katsuta, Japan

[73] Assignee: Hitachi Koki Company, Limited, Japan

[21] Appl. No.: 773,763

[22] Filed: Mar. 2, 1977

[30] Foreign Application Priority Data

Mar. 4, 1976 [JP] Japan ..... 51-23767

[51] Int. Cl.² ..... B41J 1/20

[52] U.S. Cl. ..... 101/93.14; 400/146; 400/173; 400/196.1; 400/212; 400/649; 400/656; 101/111

[58] Field of Search ..... 197/1 R, 168; 101/93.03, 93.04, 93.05, 93.13, 93.14, 96, 100, 102, 111

[56] References Cited

U.S. PATENT DOCUMENTS

| | | | |
|---|---|---|---|
| 3,400,793 | 9/1968 | Smith | 197/1 R |
| 3,583,315 | 6/1971 | Hebert | 101/96 |
| 3,726,381 | 4/1973 | Murphy | 197/168 |
| 3,730,082 | 5/1973 | Perry | 101/93.14 |
| 3,752,069 | 8/1973 | Stiles | 101/93.14 |
| 3,759,359 | 9/1973 | Stellmach | 197/1 R |
| 3,788,214 | 1/1974 | Folkens et al. | 101/96 |
| 3,904,018 | 9/1975 | Denley | 197/168 |
| 3,960,256 | 6/1976 | Bickoff et al. | 197/1 R |
| 4,023,662 | 5/1977 | Perucca | 197/1 R |
| 4,044,668 | 8/1977 | Barrus et al. | 101/93.04 |

*Primary Examiner*—Ernest T. Wright, Jr.
*Attorney, Agent, or Firm*—Robert E. Burns; Emmanuel J. Lobato; Bruce L. Adams

[57] ABSTRACT

A printing apparatus comprising a type carrier to travel along a print line on a printing paper, a plurality of printing hammers to be selectively driven to strike the printing paper against an inking ribbon and the inking ribbon against a platen in front of the inking ribbon, and a support member supporting the type carrier, inking ribbon and platen thereon, wherein the support member is movable between a position holding the type carrier, inking ribbon and platen in positions capable of performing printing operation but intercepting the line of sight between the print line and the operator's eyes and a position holding the type carrier, inking ribbon and platen in inoperative positions but providing an unobstructed line of sight from the operator's eyes toward the print line for enabling the operator to clearly view the printed information along the print line.

8 Claims, 8 Drawing Figures

PRINTING APPARATUS HAVING PRINT LINE VISIBILITY CONTROL

BACKGROUND OF THE INVENTION

1. Field of the Invention

The present invention relates to printing apparatus such as back printers or line printers and more particularly to a printing apparatus of the type which allows an operator to visually inspect the printed or typed information when the operator desires to do so or under predetermined conditions.

2. Description of the Prior Art

During use of a keyboard-operated printing apparatus having a type carrier which is arranged to travel along a horizontal print line, it is often desired by the operator to visually inspect and proofread the typed line or lines with the printing paper held in the printing position so as to see if the information that has been keyed in is correctly printed on the printing paper and the typed line or lines are properly located on the paper. If, in this instance, there exists an obstacle such as a portion of any of the type carrier, platen and inking ribbon between the operator's eyes and the line or lines on the paper which the operator desires to inspect, the line of sight of the operator is intercepted by such an obstacle so that the operator is unable to directly view the typed information without partially drawing out the printing paper from the printing position.

A printing apparatus has therefore been proposed which allows an operator to visually inspect typed characters when the operator interrupts entry of information at the keyboard. A representative example of the printing apparatus of such a nature is a back printer disclosed in U.S. Pat. No. 3,752,069. The back printer therein shown features, inter alia, a flexible type carrying band which is formed with spaced apart upstanding fingers each bearing a character to be typed. The character bearing fingers are backed up by a platen during printing and, each time the operator interrupts keying operation at the keyboard, the platen is moved out of its operative position behind the fingers and enables the operator to view the typed characters through the spaces between the successive fingers of the type carrying band as the band is driven to travel along a horizontal print line. One of the drawbacks encountered in a printing apparatus of this nature is that the line of the characters printed on the printing paper is obscured by the type bearing fingers which pass in succession over the front face of the printing paper so that the operator is permitted to recognize the printed information only by recourse to afterimages of the characters viewed and is accordingly unable to clearly and uninterruptedly proofread the typed messages. Another drawback is that the movable platen arrangement of the described prior-art apparatus owes its benefits to the type carrying band having spaced apart finger portions and is therefore not compatible in construction and in effect with ordinary type carrying bands, chains and trains which are void of such fingers. If, furthermore, an inking ribbon is used with a movable platen of the above described nature for applying ink to the printing paper, it is required to have the inking ribbon arranged to be withdrawn from its operative position together with the platen when the platen is moved out of the operative position thereof. The inking ribbon is disposed in such a manner as to form a small gap between the ribbon and the platen with the type carrying band movably passed through the gap so that not only intricate mechanical arrangements are indispensable for effecting simultaneous movement of the inking ribbon and the platen out of the respective operative positions thereof while allowing the type carrying band to freely travel through the gap but the inking ribbon tends to produce puckers when the ribbon is moved out of and back into the operative position thereof. Such puckers may hinder the printing paper and type carrying band from being fed and moved smoothly during printing operation. The platen incorporated in a printing apparatus using a horizontally travelling type carrying element is, still furthermore, preferably so arranged as to slightly protrude beyond the path of the type carrying element toward the print line in the apparatus for constantly producing a tension in the type carrying element so that the type carrying element is held in sliding contact with the rear face of the platen. Such an arrangement is broadly put to use for the purpose of enhancing the quality of the prints to be obtained and extending the lifetime of type carrying elements. When the platen in a printing apparatus of this nature is moved in a direction perpendicular to the direction of travel of the type carrying element while maintaining its sliding contact with the type carrying element, the type carrying element tends to be dragged in the particular direction due to the friction between the platen and the type carrying element. This not only hinders the platen from being smoothly moved out of and into the operative position thereof but gives rise to reduction in the service life of the type carrying element due to the added attrition between the platen and the type carrying element. The present invention contemplates elimination of all these drawbacks inherent in prior-art printing apparatus of the described characters.

SUMMARY OF THE INVENTION

It is, accordingly, a prime object of the present invention to provide an improved printing apparatus enabling an operator of the apparatus to clearly inspect and/or proofread the typed information when the operator desires to do so or under predetermined conditions.

It is another important object of the present invention to provide an improved printing apparatus which is capable of permitting an operator of the apparatus to clearly view the printed information during printing operation no matter which kind of type carrying means may be used in the apparatus.

It is still another important object of the present invention to provide an improved printing apparatus which is adapted to permit visual inspection of the typed messages by an operator of the apparatus without impairing the performance of the apparatus to feed the printing paper in proximity to the inking ribbon and the performance of the type carrying element to travel along the print line in the apparatus.

It is still another important object of the present invention to provide an improved printing apparatus in which the typed information can be viewed by an operator of the apparatus clearly and in an uninterrupted fashion when the apparatus is actuated into the conditions to provide visual inspection of the typed information.

Yet, it is another important object of the present invention to provide an improved printing apparatus having a condition intercepting the line of sight of an operator between the operator's eyes and the typed characters and a condition providing an unobstructed line of sight therebetween, the apparatus being operated between the two conditions without producing added friction between the platen and the type carrying element if the apparatus is arranged so that the platen and the type carrying element are to be constantly held in contact with each other.

In accordance with the present invention, these and other objects are accomplished in a printing apparatus for printing characters along a print line on one face of a printing paper to be in use, comprising a type carrier having a plurality of type characters carried thereon and operative to travel along a predetermined path having a portion extending in proximity to and substantially in parallel with the print line on the printing paper located on one side of the above-mentioned portion, carrier driving and guiding means for driving and guiding the type carrier to travel along the predetermined path thereof, an inking ribbon operative to travel along a predetermined path having a portion which is located between the print line on the printing paper and the above-mentioned portion of the travelling path of the type carrier and which extends in proximity to and substantially in parallel with the print line, ribbon drive means for driving the inking ribbon to travel along the predetermined path thereof, ribbon guide means for guiding the inking ribbon to move along the aforesaid portion of the travelling path thereof, a ribbon casing for feeding the inking ribbon therefrom towards the aforesaid portion of the travelling path of the ribbon and taking up therein the inking ribbon which has moved past the portion of the travelling path thereof, a plurality of printing hammers which are located on the aforesaid one side of the portion of the travelling path of the type carrier and which are juxtaposed in an array spaced apart substantially in parallel from the portion of the travelling path of the carrier, each of the printing hammers being movable into a printing position forcing the printing paper against selected one of the type characters on the type carrier across the inking ribbon, and a platen positioned on the other side of the aforesaid portion of the travelling path of the type carrier and extending along the particular portion for receiving the type carrier thereon along the print line on the printing paper when the printing hammers are selectively actuated into the respective printing portions thereof, wherein the improvement comprises a support member which has mounted thereon the type carrier, the carrier driving and guiding means, the inking ribbon, the ribbon drive means, the ribbon guide means and the platen and which is movable between a first position in which all the members on the support structure are held in operative positions enabling the printing apparatus to perform printing operation but intercepting the line of sight of an operator between the operators eyes and the typed characters along the print line on the printing paper and a second position holding the above-mentioned members out of the aforesaid positions thereof for thereby allowing the operator to view the typed characters on the print line. Preferably, the support member is arranged to be rotatable between the above-mentioned first and second positions thereof about an axis which is substantially parallel with the print line of the printing paper.

BRIEF DESCRIPTION OF THE DRAWING

The features and advantages of the printing apparatus according to the present invention will be more specifically appreciated from the following description taken in conjunction with the accompanying drawing, in which.

DESCRIPTION OF A PREFERRED EMBODIMENT

Figure 1:
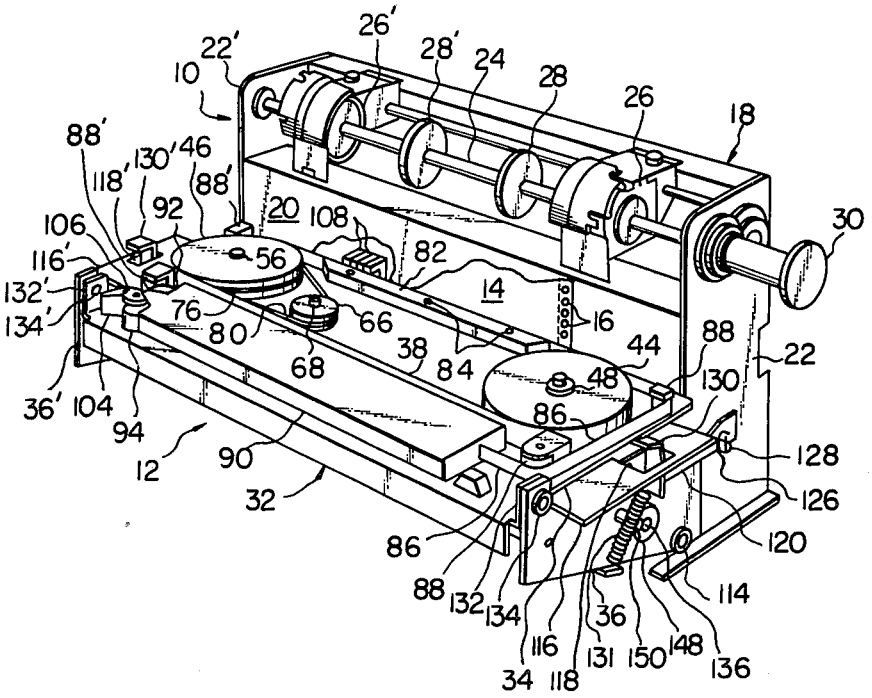
FIG. 1 is a perspective view of a preferred embodiment of the printing apparatus according to the present invention.

Referring to the drawing, first particularly to FIG. 1 thereof, the printing apparatus embodying the present invention is largely composed of a paper feed mechanism 10 for intermittently feeding a printing paper through a predetermined printing position and a printing mechanism 12 for printing characters on the front face of the printing paper. The printing paper, designated by reference numeral 14, is formed with a series of vertically spaced apart perforations 16 in each of its side margins. Both the paper feed mechanism 10 and the printing mechanism 12 are supported by a frame structure 18 having a vertical front plate 20 and a pair of vertical side plates 22 and 22'. An externally splined shaft 24 extending horizontally and laterally in the paper feed mechanism 10 is rotatably mounted on the side plates 22 and 22' and has a pair of sprocket or tractor wheels 26 and 26' and a pair of paper feed rollers 28 and 28' axially slidably mounted on the shaft 24. The tractor wheels 26 and 26' are located closer to the opposite ends of the shaft 24 than the paper feed rollers 28 and 28' which are mounted on an intermediate longitudinal portion of the shaft 24. Each of the sprocket or tractor wheels 26 and 26' has pins (not shown) which are adapted to successively enter the perforations 16 in each side margin of the printing paper 14 for stepwise moving the printing paper 14 vertically so that the paper 14 has a horizontal print line extending in predetermined relationship to the printing mechanism 12 each time the printing paper 14 is moved from one vertical position to another relative to the printing mechanism 12. The feed rollers 28 and 28' are adapted to aid in the transport of a plurality of printing papers when two or more printing papers are to be in use at a time. The splined shaft 24 has one end portion projecting from one side plate 22 of the frame structure 18 and has mounted on the end portion a knob 30 for manually rotating the shaft 24 about the axis thereof. The paper feed mechanism 10 thus constructed being well known in the art and being immaterial to the understanding of the subject matter of the present invention, description regarding more details of the construction thereof is not herein incorporated.

Figure 2:
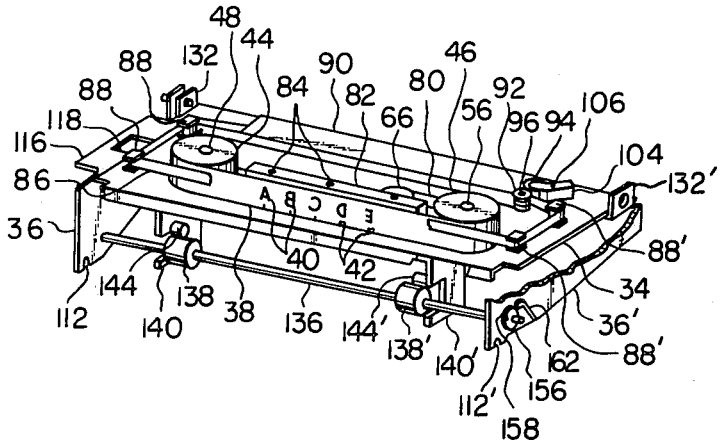
FIG. 2 is a fragmentary and partially cut-away perspective view showing part of the construction of the printing apparatus of FIG. 1 as viewed from the back of the apparatus.
Figure 3:
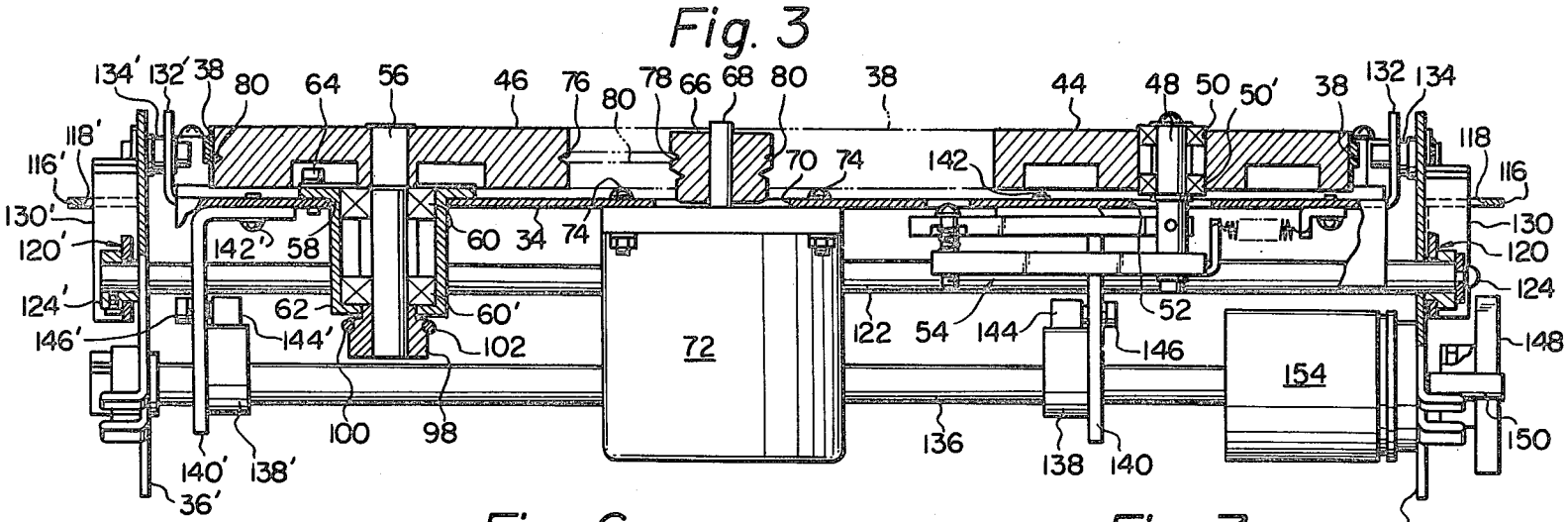
FIG. 3 is a vertical sectional view mainly of the type carrier drive means forming part of the arrangement illustrated in FIGS. 1 and 2.

Referring to FIGS. 2 to 5 as well as to FIG. 1, the printing mechanism 12 comprises a support structure 32 having a substantially flat top plate 34 and a pair of side plates 36 and 36' extending forward from lower portions of the side plates 22 and 22' of the above described frame structure 18. The top plate 34 of the support structure 32 has a rear end forwardly spaced apart from the outer face of the front plate 20 of the frame structure 18 so that the printing paper 14 is vertically passed through the gap thus formed between the front plate 20 of the frame structure 18 and the rear end of the top plate 34 of the support structure 32 as will be seen from the illustration of FIG. 1. Further details of the configuration of the support structure 32 will be clarified as the description proceeds. The printing mechanism 12 further comprises a type carrier which is constituted by an endless band 38 of, for example, flexible stainless steel. The endless band 38 has carried on its outer face a series of type characters 40 which are arranged at regular intervals throughout the length of the endless band 38 and are respectively indexed by markings 42 also formed on the outer face of the band 38, each of the type characters 40 being in a mirror-image form of the actual pattern of the character as is customary. The endless band 38 thus carrying the type characters 40 thereon is passed between first and second pulleys 44 and 46 which are positioned over the top plate 34 of the support structure 32 and which are rotatable about their respective center axes substantially normal to the upper face of the top plate 34. The first and second pulleys 44 and 46 are spaced apart from each other in a lateral direction of the printing mechanism 12 so that the endless band 38 is operable to travel along a predetermined path having a longitudinal portion which extends in proximity to and substantially in parallel with the horizontal print line on the printing paper 14 which is interposed between the rear end of the top plate 34 of the support structure 32 and the front plate 20 of the frame structure 18 when the printing apparatus is in use. The first pulley 44 is supported by and rotatable on a shaft 48 through a pair of spaced apart plain bearings 50 and 50' in which the shaft 48 is journalled as illustrated in FIG. 3, the shaft 48 being substantially normal to the upper face of the top plate 34 of the support structure 32. The shaft 48 projects downwardly through an opening 52 formed in the top plate 34 of the support structure 32 and is connected to an adjustable shaft support assembly 54 which is mounted on the underside of the top plate 34. The construction of the shaft supporting assembly 54 being a matter of design choice and, furthermore, being of little significance for the understanding of the present invention, description regarding details thereof is not herein incorporated. The second pulley 46 is supported by and rotatable with a shaft 56 which is also substantially normal to the upper face of the top plate 34 of the support structure 32. The shaft 56 projects downwardly from the lower end of the pulley 46 and is passed through an opening 58 formed in the top plate 34 of the support structure 32 below the pulley 46, as shown in FIG. 3. The shaft 56 is journalled in a pair of spaced apart plain bearings 60 and 60' which are housed in a generally cylindrical hollow bearing retainer 62 having an annular flange portion at its upper end. The bearing retainer 62 is passed through the opening 58 in the top plate 34 and is securely mounted on the top plate 34 by suitable fastening means connecting the flange portion of the bearing retainer 62 to the upper face of the top plate 34 as at 64. The shaft 56 projects downwardly from the bottom of the bearing retainer 62 for the reason to be explained later.

Between the first and second pulleys 44 and 46 thus arranged is located a third pulley 66 which is also positioned over the top plate 34 of the support structure 32 and which is mounted on and rotatable with a shaft 68 substantially normal to the top plate 34. The shaft 68 is passed through an opening 70 formed in the top plate 34 of the support structure 32 as shown in FIG. 3 and is connected to or integral with the output shaft of an electric motor 72 which is positioned below the top plate 34 and which is mounted on the underside of the top plate 34 by suitable fastening means as at 74.

The second and third pulleys 46 and 66 are formed with circumferential grooves 76 and 78, respectively, having similar V-shaped cross sections as seen in FIG. 3. An endless belt 80 is passed between the pulleys 46 and 66 and is received along its opposite turning end portions in these grooves 76 and 78. The endless belt 80 has a V-shaped cross section which has a thickness less than the depth of the cross sections of the grooves 76 and 78 in the pulleys 46 and 66 so that the outer face of the belt 80 is slightly lower than the outer peripheral surfaces of the pulleys 46 and 66 where the belt 80 is wrapped on the pulleys 46 and 66. The endless band 38 carrying the type characters 40 in its outer face is, thus, evenly received on the outer peripheral surface of the second pulley 46 and is spaced apart from the outer face portion of the belt 80 along its turning end portion wrapped on the second pulley 46 as will be clearly seen from FIG. 3.

The above described arrangement including the pulleys 44, 46 and 66, the motor 72, the endless belt 80 and the associated shafts and bearings constitutes the carrier driving and guiding means in the embodiment of the present invention.

As shown in FIGS. 1 and 2, the printing mechanism 12 of the apparatus embodying the present invention further comprises an elongated platen 82 which has a flat vertical rear face extending in proximity to and substantially in parallel with the front face of that rear longitudinal portion of the endless band 38 which is to travel between the first and second pulleys 44 and 46. In other words, the platen 82 is positioned on the front side of the previously mentioned portion of the travelling path of the endless band 38 so that the endless band 38 bears against the rear face of the platen 82 along the print line on the printing paper 14 when forced forwardly as will be described later in more detail. The platen 82 is fixedly mounted on the upper face of the top plate 34 of the support structure 32 by suitable fastening means as at 84.

An inking ribbon 86 is arranged to travel along a predetermined path having a portion which is located between the print line on the printing paper 14 in the printing position and the above-mentioned portion of the travelling path of the character carrying endless band 38 and which extends in proximity to and substantially in parallel with the print line. Ribbon guide means are thus provided which include a plurality of ribbon guide elements 88 and 88' mounted on the top plate 34 of the support structure 32 as shown in FIGS. 1 and 2 and located in such a manner as to enable the inking ribbon 86 to travel along the above-mentioned path thereof. The inking ribbon 86 is closely interposed along the above-mentioned portion of its travelling path between the outer character carrying face of the endless band 38 and the front face of the printing paper 14 when the printing paper 14 is forced forwardly as will be described later. The inking ribbon 86 is stored in folded or otherwise packed condition within an elongated ribbon casing 90 located in front of the pulleys 44, 46 and 66 and fixedly but detachably mounted on the upper face of a front end portion of the top plate 34 of the support structure 32 as shown in FIGS. 1 and 2. The inking ribbon 86 thus initially housed in the ribbon casing 90 is fed from one end of the ribbon casing 90 toward the above described portion of the travelling path of the ribbon 86 through the guide elements 88. The ribbon 86 which has moved past the particular portion of the travelling path thereof is conveyed toward the other end of the ribbon casing 90 through the guide elements 88'. Such movement of the inking ribbon 86 is effected by ribbon drive means including a pair of rollers 92 and 94 which are located in the neighborhood of the withdrawal or take-up end of the ribbon casing 90 and which are rotatable about their respective center axes substantially normal to the upper face of the top plate 34 of the support structure 32. One roller 92 is a drive roller and is mounted on and rotatable with a shaft 96 (FIG. 2). Though not shown, the shaft 96 thus supporting the driving roller 92 projects downwardly through an opening formed in the top plate 34 of the support structure 32 and is connected at its lower end to a circumferentially grooved pulley. As illustrated in FIG. 3, the shaft 56 supporting the second pulley 46 forming part of the previously described carrier driving and guiding means has mounted on its lower end portion projecting downwardly from the bottom of the bearing retainer 62 a pulley 98 which is formed with a circumferential groove 100. An endless belt 102 is passed between this pulley 98 and the pulley (not shown) on the shaft 96 of the driving roller 92 so that driving connection is provided from the motor 72 to the drive roller 92 through the third pulley 66, endless belt 80, second pulley 46 and shaft 56 of the carrier driving and guiding means and further through the pulley 98 on the shaft 56 and the endless belt 102 on the pulley 98. The other roller 94 is a pressing roller and is rotatably supported by a spring loaded lever 104 which is pivotally mounted on the top plate 34 of the support structure 32 by a pin 106 as seen in FIG. 1. The driving and pressing rollers 92 and 94 are held by means of the spring loaded lever 104 in pressing contact or, during operation, in rolling contact with each other with the inking ribbon 86 pressed upon therebetween. When the electric motor 72 is in operation, the endless band 38 carrying the type characters 40 and the inking ribbon 86 are driven to travel in the same senses and at different velocities along the print line on the printing paper 14 in the printing position. The inking ribbon 86 moved past the driving and pressing rollers 92 and 94 is conveyed back into the ribbon casing 90 and is taken up in a suitable manner within the casing 90.

Figure 7:
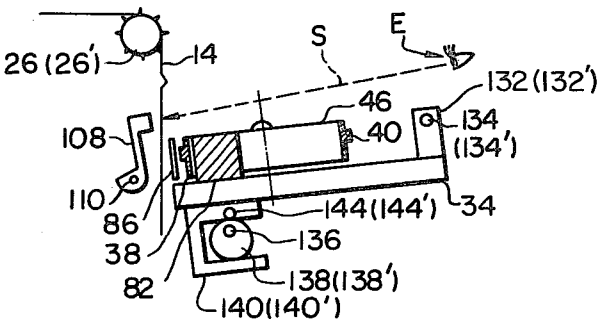
FIGS. 6 and 7 are schematic views showing, each partially in cross section, some component parts of the embodiment of FIGS. 1 to 4, wherein the parts shown in FIG. 6 are in positions intercepting the line of sight between the typed character and the operator's eyes and the parts shown in FIG. 7 are in positions providing an unintercepted line of sight between the typed characters and the operator's eyes.
Figure 6:
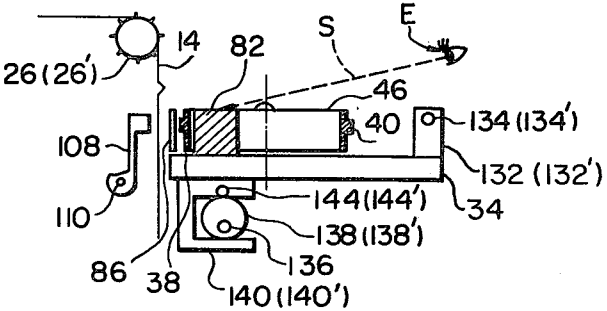

The printing mechanism 12 of the apparatus embodying the present invention further comprises a plurality of printing hammers 108 which are housed within the frame structure 18 and which are located rearwardly of the rear end of the top plate 34 of the support structure 32 as will be seen from FIG. 1. The printing hammers 108 are juxtaposed in a row which is rearwardly spaced apart substantially in parallel from the previously mentioned portions of the respective travelling paths of the character carrying endless band 38 and the inking ribbon 86 as will be better seen from FIGS. 6 and 7. The hammers 108 are rotatably mounted on at least one horizontal shaft 110 (FIGS. 6 and 7) which extends in parallel with the rear face of the elongated platen 82 so that each of the hammers 108 is rotatable about the axis of the shaft 110 between a rest position rearwardly spaced apart from the reverse side of the printing paper 14 as shown in FIGS. 6 and 7 and a printing position having its upper end portion in pressing contact with the reverse side of the printing paper 14 which is thus pressed against the inking ribbon 86, which presses, in turn, the character carrying endless band 38 against the rear face of the platen 82. The individual printing hammers 108 are connected to drive means (not shown) adapted to selectively drive the hammers 108 into the respective printing positions thereof under the control of signals which are produced in the keyboard (not shown). Such drive means and keyboard being well known in the art and being rather immaterial to the understanding of the essential features of the present invention, description regarding the detailed construction and operation thereof is not herein incorporated. The support structure 32 thus supports thereon the character carrying endless band 38, the driving and guiding means for the band 38, the platen 82, the drive and guide means for the inking ribbon 86, the ribbon casing 90 and the various parts and elements mechanically connected to these means of the printing mechanism 12.

Figure 4:
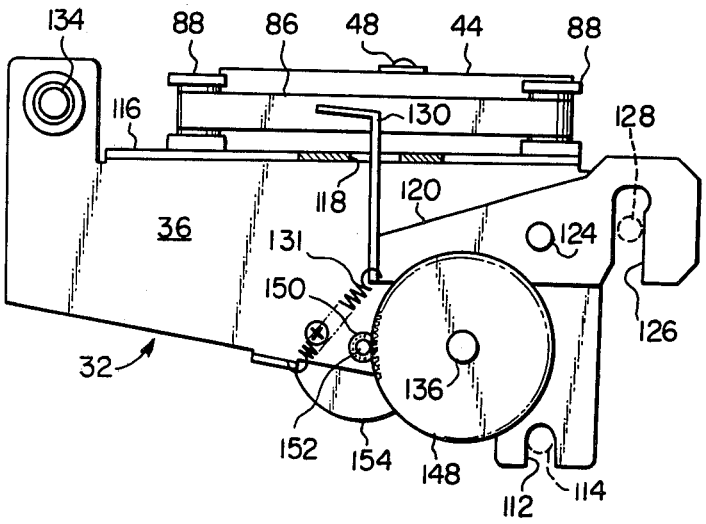
FIG. 4 is a side end view of the printing apparatus of FIG. 1 as viewed from one or right-hand side end of FIG. 1.
Figure 5:
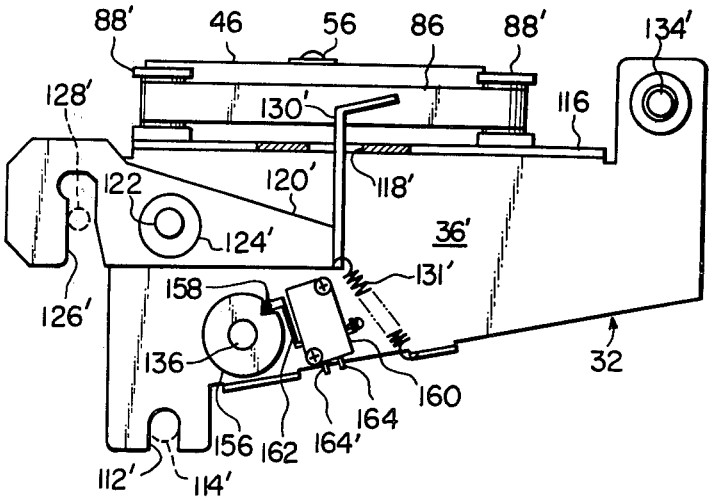
FIG. 5 is a view similar to FIG. 4 but shows the printing apparatus as viewed from the other or left-hand side end of FIG. 1.

The side plates 36 and 36' of the support structure 32 have their rear end portions located on the outer faces of lower portions of the side plates 22 and 22', respectively, of the frame structure 18 and are formed with vertical slots 112 and 112', respectively, which are open at their lower ends and which terminate with semicircular edges at their upper ends as shown in FIGS. 4 and 5, respectively. The side plates 36 and 36' of the support structure 32 are detachably mounted on the side plates 22 and 22' of the frame structure 18 by means of pins 114 and 114' (indicated by dotted lines in FIGS. 4 and 5) which horizontally project from the outer face of the side plates 22 and 22', respectively, of the frame structure 18 and which slidably receive in weight bearing relationship the semicircular upper edges of the slots 112 and 112' in the side plates 36 and 36', respectively, as will be seen from FIG. 1 in which only one pin 114 is shown. The pins 114 and 114' having respective center axes which are in line with each other in a lateral direction of the frame structure 18, the side plates 36 and 36' of the support structure 32 are rotatable relative to the frame structure 18 about a fixed axis which contains the respective center axes of the pins 114 and 114'. The side plates 36 and 36' of the support structure 32 have flange portions 116 and 116', respectively, which are perpendicularly bent laterally outwardly from the upper end of the side plates 36 and 36' and which are formed with square-shaped openings 118 and 118', respectively, as will be best seen in FIG. 1. Levers 120 and 120' are rotatably mounted on an elongated shaft 122 extending in a horizontal direction between the side plates 36 and 36' and fixedly connected at its opposite ends to the side plates 36 and 36' by suitable fastening means as at 124 and 124', respectively, as will be best seen in FIG. 3 so that the levers 120 and 120' are slidable on the outer faces of the side plates 36 and 36', respectively, about the center axis of the shaft 122. The levers 120 and 120' are formed with vertical slots 126 and 126', respectively, which are open at their lower ends and which terminate with generally semicircular upper edges each having a diameter slightly larger than the width of the elongated lower portion of the slot 126 or 126' out of which the circular portion of the slot 126 or 126' merges, as seen in FIGS. 4 and 5. The side plates 22 and 22' of the frame structure 18 has pins 128 and 128' (indicated by dotted lines in FIGS. 4 and 5, respectively) which project horizontally from the outer faces of the side plates 22 and 22', respectively, and which are substantially in line with each other in a lateral direction of the frame structure 18. The levers 120 and 120' are detachably mounted on the side plates 22 and 22', respectively, of the frame structure 18 with the curved upper edges of the slots 126 and 126' received in weight transmitting relationship on the pins 128 and 128', respectively, as will be best seen in FIG. 1 in which only the pin 128 on one side plate 22 is illustrated. The levers 120 and 120' are further formed with upstanding strip portions 130 and 130', respectively, which are bent, each in part, forwardly and which are passed through the openings 118 and 118', respectively. The levers 120 and 120' are connected by tension springs 131 and 131' to the side plates 36 and 36', respectively. When the side plates 36 and 36' are held in the positions having the pins 128 and 128' located in the elongated lower portions of the slots 126 and 126', respectively, as indicated by dotted lines in FIGS. 4 and 5, the support structure 32 is maintained in a position ready to perform the printing operation. If the levers 120 and 120' are moved to turn rearwardly upwardly about the shaft 122 by raising the upstanding strip portions 130 and 130' thereof backwardly, the pins 128 and 128' are received in the enlarged closed upper end portions of the slots 126 and 126', respectively, so that the support structure 32 is turned forwardly downwardly about the pins 114 and 114' by reason of the weights of the support structure 32 and the members and units supported on the support structure 32. An elongated gap is consequently formed between the rear end of the top plate 34 of the support structure 32 and the front plate 20 of the frame structure 18, making it easier to insert a printing paper 14 therebetween. When the side plates 36 and 36' are thereafter turned rearwardly upwardly about the shaft 122, the retaining pins 128 and 128' are received in the elongated lower portions of the slots 126 and 126' in the levers 120 and 120', respectively, so that the support structure 32 is forced by the tension springs 131 and 131' to turn rearwardly upwardly about the pins 114 and 114' supporting the side plates 36 and 36', respectively, of the support structure 32, which thus resumes the initial position ready to perform the printing operation. The mechanical connection between the frame structure 18 and the support structure 32 thus provides allowance for the support structure 32 to be rotatable forwardly about the axis passing through the aligned axes of the pins 114 and 114' so that the gap between the character carrying band 38 on the support structure 32 and the row of the printing hammers 108 within the frame structure 18 can be enlarged when the printing paper 14 is to be set in the printing position.

The top plate 34 of the support structure 32 has a pair of upstanding projections 132 and 132' which are bent upwardly from the side ends of a front end portion of the top plate 34. The projections 132 and 132' of the top plate 34 are slightly spaced apart in horizontal direction from the inner faces of the side plates 36 and 36', respectively, of the support structure 32 and are rotatably connected to the side plates 36 and 36' by shafts 134 and 134', respectively, which have center axes substantially in line with each other in a horizontal lateral direction of the support structure 32. The top plate 34 of the support structure 32 is, thus, rotatable about an axis which passes through the aligned center axes of the shafts 134 and 134'.

An enlongated cam shaft 136 extends in a horizontal lateral direction of the support structure 32 and below a rear end portion of the top plate 34 of the support structure 32 and is rotatably supported at both ends thereof on the side plates 36 and 36' of the support structure 32 with its axial end portions projecting from the outer faces of the side plates 36 and 36', as seen in FIGS. 2 and 3 and in part in FIG. 1. The cam shaft 136 has fixedly mounted thereon a suitable number of, herein assumed as two, eccentric cam rollers 138 and 138' which are located between the side plates 36 and 36' of the support structure 32 and which are suitably spaced apart from each other in the axial direction of the cam shaft 136, the cam rollers 138 and 138' having respective cam lobes which are substantially aligned with each other in the axial direction of the shaft 136 as will be seen from FIGS. 6 and 7. A pair of generally U-shaped brackets 140 and 140' are fixedly attached to the lower face of the top plate 34 of the support structure 32 by suitable fastening means as at 142 and 142' (FIG. 3). The brackets 140 and 140' are located in the vicinity of the cam rollers 138 and 138', respectively, and have supported thereon cam follower rollers 144 and 144' by shafts 146 and 146', respectively, having center axes substantially parallel with the elongated cam shaft 136 and in line with each other. The cam follower rollers 144 and 144' are located above the cam shaft 136 and are in rollable contact with the eccentric cam rollers 138 and 138', respectively. When, thus, the cam rollers 138 and 138' are in angular positions contacting at their points radially remotest from the center axis of the cam shaft 136, with the cam follower rollers 144 and 144', respectively, the cam follower rollers 144 and 144' are in the most raised positions thereof over the shaft 136 secured to the side plates 36 and 36' of the support structure 32 so that the top plate 34 of the support structure 32 assumes a substantially horizontal position as shown in FIG. 6. When, conversely, the cam rollers 138 and 138' are in angular positions bearing at their points closest to the center axis of the cam shaft 136 against the cam follower rollers 144 and 144', respectively, then the cam follower rollers 144 and 144' are in the most lowered positions thereof over the shaft 136 secured to the side plates 36 and 36' of the support structure 32 so that the top plate 34 of the support structure 32 is rearwardly and downwardly inclined as shown in FIG. 7. As the cam rollers 138 and 138' are rotated between the above-mentioned angular positions thereof, therefore, the top plate 34 of the support structure 32 is turned about the axis passing through the center axes of the shafts 134 and 134' between a substantially horizontal first angular position having the members and elements on the top plate 34 in normal operative positions in front of the row of the printing hammers 108 as shown in FIG. 6 and a rearwardly and downwardly inclined second angular position having such members and elements in inoperative positions downwardly withdrawn from the front of the row of the printing hammers 108 as shown in FIG. 7. When the top plate 34 is thus held in the first angular position shown in FIG. 6, the line of sight S of an operator of the printing apparatus between the printed character along the print line on the printing paper 14 and the operator's eyes E is intercepted by any of the members and elements such as the rear travelling portion of the character carrying band 38, the platen 82 and/or the rear travelling portion of the inking ribbon 86 supported on the top plate 34. When, however, the top plate 34 of the support structure 32 is turned into the second angular position thereof as illustrated in FIG. 7, all the members and elements on the top plate 34 are withdrawn from the line of sight S from the operator's eyes E so that the operator is enabled to directly view the printed characters along the print line on the printing paper 14. As in every type of printing apparatus, the print line on any printing paper for use in the printing apparatus according to the present invention has a maximum allowable length which is predetermined in the apparatus and which is, specifically, dictated by the overall width of the printing apparatus.

Turning back to FIGS. 1 to 5 of the drawing, the cam shaft 136 has mounted at one axial end thereof a spur gear 148 which is rotatable with the shaft 136 over the outer face of one side plate 36 of the support structure 32. The spur gear 148 is in mesh with a pinion 150 which is connected to the output shaft 152 (FIG. 4) of a pulse motor 154 which is mounted on the inner face of the side plate 36 of the support structure 32 as will be best seen in FIG. 3. The cam shaft 136 has further fixedly mounted at the other axial end thereof a circular disc 156 rotatable with the shaft 136 over the outer face of the other side plate 36' of the support structure 32 and formed with a V-shaped notch 158 in its outer peripheral wall as will be best seen in FIG. 5. The side plate 36' of the support structure 32 has fixedly mounted on its outer face a microswitch 160 which has an actuating element 162 constituted by a click which is held in engagement with the circular disc 156 on the cam shaft 136 and which has a first angular position having its leading end portion received in the notch 158 in the disc 156 as shown in FIG. 5 and a second angular position having its leading end portion bearing against the outer peripheral surface of the disc 156 as shown in FIG. 2. The microswitch 160 is closed and open when the actuating element or click 162 is in the abovementioned first and second angular positions, respectively. In this instance, it is important that the V-shaped notch 158 be located in the circular disc 156 in such a manner that the notch 158 is engaged by the actuating element 162 when the cam rollers 138 and 138' on the cam shaft 136 supporting the disc 156 are in the previously described positions bearing at their points remotest from the center axis of the shaft 136 against the respectively associated cam follower rollers 144 and 144', viz., when the top plate 34 of the support structure 32 is in the substantially horizontal first angular position allowing the printing apparatus to perform the printing operation. The actuating element 162 of the microswitch 160 may be provided with a roller at its leading end so as to make smooth the motion of the actuating element 162 between the first and second angular positions thereof. The microswitch 160 has one terminal 164 connected to the above described pulse motor 154 through a control circuit to be described and the other terminal 164' connected to ground.

Figure 8:
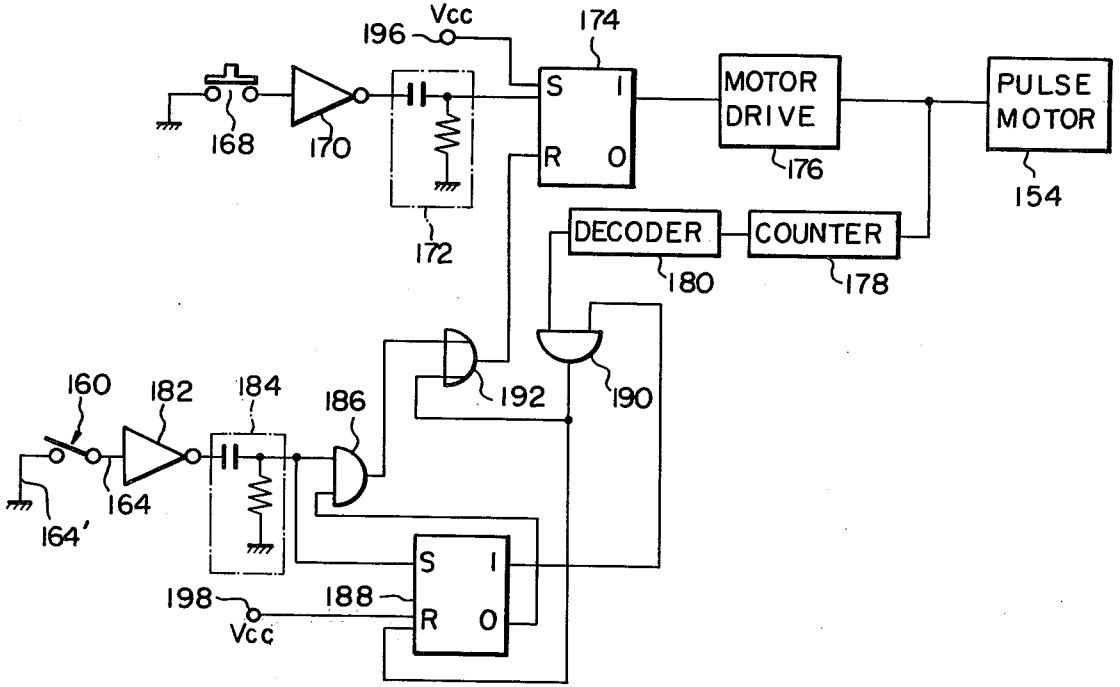
FIG. 8 is a diagram showing, partly in block form, a preferred example of a circuit arrangement forming part of control means incorporated in the embodiment of FIGS. 1 to 7.

Referring to FIG. 8, the above-mentioned control circuit is shown comprising a manually-operated normally-open motor-drive switch 168 which is connected through an inverter 170 to a differentiator 172. The differentiator 172 has its output terminal connected to the set terminal S of a first flip-flop circuit 174. The flip-flop circuit 174 has a logic "1" output terminal connected to a motor-drive pulse generator 176 which in turn has its output terminal connected to the above described pulse motor 154. When, thus, the motor-drive switch 168 is closed, the flip-flop circuit 174 is set and accordingly brought into "one" state so that the motor-drive pulse generator 176 is actuated and supplies driving pulses to the pulse motor 154. The output terminal of the motor-drive pulse generator 176 is also connected to a pulse counter 178 the output terminal of which is connected to a decoder 180. The decoder 180 is adapted to produce a logic "1" output signal when the number of the pulses delivered from the motor-drive pulse-generator 176 reaches a predetermined value which approximately corresponds to a half turn of the cam shaft 136 to be driven for rotation by the pulse motor 154.

The terminal 164 of the above described microswitch 160 is connected through a series combination of an inverter 182 and a differentiator 184 to one input terminal of a first two-input "AND" gate circuit 186 and to the set terminal S of a second flip-flop circuit 188. The second flip-flop circuit 188 has a logic "1" output terminal connected to one input terminal of a second two-input "AND" gate circuit 190 and a logic "0" output terminal connected to the other input terminal of the first "AND" gate circuit 186. The other input terminal of the second "AND" gate circuit 190 is connected to the output terminal of the above-mentioned decoder 180. The output terminal of the first "AND" gate circuit 186 is connected to one input terminal of a two-input "OR" gate circuit 192 while the output terminal of the second "AND" gate circuit 190 is connected to the reset terminal R of the second flip-flop circuit 188 and to the other input terminal of the "OR" gate circuit 192. The output terminal of the "OR" gate circuit 192 is connected to the reset terminal R of the first flip-flop circuit 174. Indicated at 196 and 198 are control current supply terminals connected to the first and second flip-flop circuits 174 and 188, respectively. Each of the differentiators 172 and 184 is provided for the purpose of producing a positive pulse at its output terminal when the associated switch 168 or 160 is closed to connect the inverter 170 or 182 to ground. When the switch 168 or 160 is kept open or closed, there is no output signal delivered from the differentiator 172 or 184.

The operation of the control circuit thus constructed and arranged will be hereinafter described with concurrent reference to FIGS. 1 to 8 of the drawing.

When a control current is supplied to the control current supply terminals 196 and 198, the first flip-flop circuit 174 is set and at the same time the second flip-flop circuit 188 is brought into the reset condition thereof. Under these conditions, the pulse motor 154 is energized by the pulses delivered thereto from the motor-drive pulse generator 176 without respect to the angular position of the top plate 34 of the support structure 32 until the circular disc 156 on the cam shaft 136 driven by the motor 154 through the spur gear 148 and pinion 150 reaches the angular position having the actuating element 162 of the microswitch 160 caught at its leading end in the V-shaped notch 158 in the disc 156 as shown in FIG. 5. When the actuating element 162 is thus caught at its leading end in the notch 158 in the disc 156 and assumes the above mentioned first angular position thereof, the microswitch 160 is caused to close so that the first flip-flop 174 of the control circuit shown in FIG. 8 is reset by the signals which are passed through the inverter 182, differentiator 184, first "AND" gate circuit 186 and "OR" gate circuit 192. The motor-drive pulse generator 176 is accordingly made inoperative and brings the pulse motor 154 to a full stop, thereby holding the cam rollers 138 and 138' on the cam shaft 136 in the angular positions bearing at their points remotest from the center axis of the cam shaft 136 against the respectively associated cam followers 144 and 144'. The top plate 34 of the support structure 32 is therefore held in the substantially horizontal first angular position blocking the operator's line of sight S, as illustrated in FIG. 6. Once the microswitch 160 is closed as above discussed, the second flip-flop circuit 188 is maintained in the "one" state until the second "AND" gate circuit 190 is rendered into condition to produce its output signal as will be described.

If the motor-drive switch 168 is closed manually by the operator under these conditions, the first flip-flop circuit 174 is set and accordingly brought into the "one" state thereof so that the pulse motor 154 is started to operate by the pulses fed from the motor-drive pulse generator 176. The cam rollers 138 and 138' which have been in contact at their points remotest from the center axis of the cam shaft 136 with the cam follower roller 144 and 144', respectively are now driven to rotate about the center axis of the cam shaft 136 and, as a consequence, the top plate 34 of the support structure 32 is caused to turn from the horizontal first angular position shown in FIG. 6 toward the rearwardly and downwardly inclined second angular position shown in FIG. 7 about the axis which passes through the respective center axes of the shafts 134 and 134' by which the top plate 34 is pivotally mounted on the side plates 36 and 36' of the support structure 32. When the cam rollers 138 and 138' are thus driven, the disc 156 on the cam shaft 136 is rotated about its axis and causes the actuating element 162 of the microswitch 160 to move out of the first angular position thereof, thereby causing the microswitch 160 to open. As the top plate 34 of the support structure 32 is being moved from the first angular position toward the second angular position thereof, the pulses delivered from the motor-drive pulse generator 176 are fed not only to the pulse motor 154 but also to the pulse counter 178. When the number of the pulses thus supplied to the pulse counter 178 reaches the previously mentioned predetermined value that approximately corresponds to a half turn of the cam shaft 136, then the decoder 180 connected to the output terminal of the pulse counter 178 delivers its logic "1" output signal to the second "AND" gate circuit 190. Because, in this instance, the second flip-flop circuit 188 is maintained in the "one" state thereof with the microswitch 160 kept open, the second "AND" gate circuit 190 is supplied with logic "1" signals at both of its input terminals and delivers its logic "1" output signal to the "OR" gate circuit 192 at the instant when the decoder 180 delivers the logic "1" output signal. The first flip-flop circuit 174 is thus cleared by the output signal of the "OR" gate circuit 192 and disables the motor-drive pulse generator 176 from supplying pulses to the pulse motor 154. The cam rollers 138 and 138' on the cam shaft 136 which has been driven by the motor 154 are now held in the angular positions bearing at their points closest to the center axis of the cam shaft 136 against the respectively associated cam follower rollers 144 and 144' so that the top plate 34 of the support structure 32 is held in the rearwardly and downwardly inclined second angular position thereof as illustrated in FIG. 7, enabling the operator to directly view the printed characters along the print line on the printing paper 14 clear over the members and units supported on the top plate 34. The output signal of the second "AND" gate circuit 190 is fed not only to the "OR" gate circuit 192 as above described but to the reset terminal R of the second flip-flop circuit 188, which is accordingly brought into the "zero" state thereof simultaneously when the first flip-flop circuit 174 is reset by the output signal from the "OR" gate circuit 192.

When the motor-drive switch 168 is thereafter closed for a second time by the operator, the pulse motor 154 is enabled to operate until the actuating element 162 of the microswitch 160 has its leading end portion caught in the V-shaped notch 158 in the circular disc 156 on the cam shaft 136 and accordingly the microswitch 160 is closed. With the microswitch 160 thus closed, the first "AND" gate circuit 186 is conditioned to deliver the logic "1" output signal to the "OR" gate circuit 192 in the presence of the logic "1" signals at both of the input terminals of the first "AND" gate circuit 186. The first flip-flop circuit 174 is therefore brought into the "zero" state thereof and causes the pulse motor 154 to stop its operation through the motor-drive pulse generator 176. The cam rollers 138 and 138' on the cam shaft 136 now resume the initial angular positions bearing at their points remotest from the center axis of the cam shaft 136 against the respectively associated cam follower rollers 144 and 144' and hold the top plate 34 of the support structure 32 in the substantially horizontal first angular position thereof as shown in FIG. 6, enabling the printing apparatus to proceed with the printing operation.

From the foregoing description it will have been clearly understood that, since all the members and elements supported on the upper face of the top plate 34 of the support structure 32 can be moved into the positions providing an unobstructed line of sights between the print line on the printing paper 14 and the operator's eyes E simply by closing the motor-drive switch 168, not only is the operator permitted to arbitrarily view the printed information along the print line on the printing paper 14 without being interferred with by any of the members and elements on the upper face of the top plate 34 but such a feature can be attainable whichsoever type of character carrier may be put to use in the printing apparatus. Because, furthermore, all the members and elements on the top plate 34 of the support structure 32 can be moved as a single unit together with the top plate 34, there is brought about no change among the relative positions of such members and elements to each other when the members and elements are moved with the top plate 34. For this reason, the initially designed positional relationship among the printing paper 14, character carrying band 38, platen 82 and inking ribbon 86 can be maintained unchanged after the band 38, platen 82 and inking ribbon 86 have been moved with the top plate 34 so that, not only is the printing paper 14 permitted to be fed smoothly and the character carrying band 38 and the inking ribbon 86 are permitted to travel smoothly when the members and elements on the top plate 34 are moved back into the initial operative positions but, because of the fact that the spacing between the character carrying band 38 and the platen 82 can be at all times maintained unchanged, deterioration in the quality of the prints obtained and in the life-time of the character carrying band 38 can be avoided without having recourse to provision of such mechanical arrangements that would otherwise be indispensable for effecting simultaneous motions of the inking ribbon 86 and the platen 82 for example.

It has been assumed in the foregoing description that the pulse motor 154 is to be driven when the motor-drive switch 168 is manually closed by an operator. This, however, is merely for the purpose of description and, if desired, arrangement may be made so that the motor 154 is to be initiated into motion if the keying operation is interrupted for a predetermined period of time as in the previously named U.S. Pat. No. 3,752,069. It will be, furthermore, quite apparent that the driving means for the cam shaft 136 is not limited to a pulse motor but may be constituted by any other type of electric motor or by a driving unit using an electromagnet. The drive and driven rollers 92 and 94 for driving the inking ribbon 86 may be located within the ribbon casing 90 if desired.

What is claimed is:

1. A printing apparatus for printing characters on a printing paper along a print line having a maximum allowable length which is predetermined in the apparatus, comprising, in combination, a plurality of printing hammers arranged in a row substantially parallel with said print line and located on one side of the print line; a support member positioned on the other side of the print line and having an elongated lateral end extending in proximity to and substantially in parallel with said print line, said support member being tiltable about an axis which is substantially parallel with said lateral end and spaced apart from said print line opposite said printing hammers; an elongated platen fixedly mounted on said support member and extending along a major portion of said lateral end of the support member for forming an elongated gap between said platen and said print line; a type carrier mounted on said support member and having a plurality of type characters carried thereon; carrier driving and guiding means mounted on said support member and operative to drive and guide said type carrier along a predetermined path having a longitudinal portion extending throughout said gap and having a length which is not less than said maximum allowable length of said print line; ribbon guide means arranged on said support member and operative to guide an inking ribbon to travel over the support member along a predetermined path having longitudinal portion located between said print line and said longitudinal portion of the travelling path of said type carrier, said longitudinal portion of the travelling path of the inking ribbon having a length not less than said maximum allowable length of the print line; ribbon drive means mounted on said support member and operative to drive said inking ribbon along said predetermined path thereof; and shifting means held in engagement with said support member and operative to drive the support member to turn about said axis between a first angular position holding said platen, type carrier, carrier driving and guiding means, ribbon guide means and ribbon drive means operative and a second angular position in which said platen, said type carrier, said carrier driving and guiding means, said inking ribbon, said ribbon guide means and said ribbon drive means are held inoperative and located off a line of sight between said print line and operator's eyes located in front of the apparatus, wherein said shifting means comprises at least one cam roller rotatable about a fixed axis substantially parallel with said axis about which said support member is tiltable, a rigid member having a fixed position relative to said support member, said cam roller being in rollable engagement with said rigid member, said support member being tiltable between said first and second angular positions depending upon the rotatable position of the cam roller and relative to said rigid member, said cam roller being in weight bearing relationship to said platen, type carrier, driving and guiding means, ribbon guide means and ribbon drive means through said support member and said rigid member irrespective of the angular position of the support member about said axis thereof, and a pulse motor drivingly connected to said cam roller.

2. A printing apparatus as set forth in claim 1, in which said type carrier consists of an endless band of a flexible strip having said type characters arranged along the travelling path of the type carrier.

3. A printing apparatus as set forth in claim 1, further comprising a ribbon casing having a ribbon feed-out and a ribbon take-up end and mounted on said support member in weight transmitting relationship to said shifting means through the support member, said ribbon guide means being arranged so that said predetermined path of the inking ribbon originates at said ribbon feed-out end and terminates at said ribbon take-up end.

4. A printing apparatus as set forth in claim 1, in which said print line and said support member axis commonly lie on a substantially horizontal plane and in which said lateral end is located on said horizontal plane when said support member is in said first angular position and below said horizontal plane when the support member is in said second angular position.

5. A printing apparatus as set forth in claim 1, in which said shifting means further comprises a circular disc rotatable with said cam roller and formed with a notch in a radial direction and electric switch means electrically connected to said pulse motor and including an actuating element engageable with said disc, said notch being located in the disc so that said actuating element is in engagement with said disc through said notch when said cam roller is in an angular position having said support member in said first angular position thereof, said switch means being operative to deenergize said pulse motor when said actuating element is brought into engagement with said disc through said notch.

6. A printing apparatus as set forth in claim 1, in which said rigid member has a cylindrical outer peripheral surface having a center axis fixed with respect to said support member and substantially parallel with said fixed axis of said cam roller, the cam roller being in rollable contact with said cylindrical outer peripheral surface of said rigid member.

7. A printing apparatus for printing characters along a print line on one face of a printing paper, comprising a type carrier which has a plurality of type characters carried thereon and which is operative to travel along a predetermined path having a portion extending in proximity to and substantially parallel with said print line on the printing paper located on one side of said portion, carrier driving and guiding means for driving and guiding said type carrier to travel along said predetermined path thereof, an inking ribbon to travel along a predetermined path having a portion located between said print line and said portion of the travelling path of the type carrier and extending in proximity to and substantially in parallel with said print line, ribbon drive means for driving the inking ribbon to travel along the predetermined path thereof, ribbon guide means for guiding the inking ribbon to move along the predetermined path thereof, a ribbon casing for feeding the inking ribbon therefrom toward said portion of the travelling path of the inking ribbon and taking up therein the inking ribbon which has been moved past said portion of the travelling path thereof, a plurality of printing hammers located on said one side of said portion of the travelling path of the type carrier and juxtaposed in a row spaced apart substantially in parallel from said portion of the travelling path of the type carrier, and a platen positioned on the other side of and extending along said portion of the travelling path of the carrier, wherein the improvement comprises a support member having mounted thereon members including said type carrier, said carrier driving and guiding means, said inking ribbon, said ribbon drive means, said ribbon guide means and said platen and rotatable about an axis substantially parallel with said print line between a first angular position holding said members in operative positions capable of performing printing operation but intercepting a line of sight between said print line and operator's eyes and a second angular position holding said members out of said operative positions thereof and providing an unobstructed line of sight between said print line and the operator's eyes, cam rollers axially aligned with each other and rotatable about an axis substantially parallel with the axis about which said support member is rotatable, rigid members having fixed positions relative to said support member, said cam rollers being in rollable engagement with said rigid members, respectively, the support member being rotatable between said first and second angular positions depending upon the rotational positions of said cam rollers relative to said rigid members, said cam rollers being in weight bearing relationship to said platen, type carrier, carrier driving and guiding means, ribbon guide means and ribbon drive means through said support member and said rigid members irrespective of the angular position of the support member about said axis thereof, a pulse motor drivingly connected to said cam rollers, and a circular disc rotatable with said cam rollers and formed with a notch in radial direction and electric switch means connected to said pulse motor and including an actuating element engageable with said disc, said notch being located in the disc so that the actuating element of said switch means is in engagement with the disc through said notch when said cam rollers are in angular positions having said support member in said first angular position thereof, said switch means being operative to de-energize said pulse motor when said actuating element is brought into engagement with said disc through said notch.

8. A printing apparatus as set forth in claim 7, in which each of said rigid members has a cylindrical outer peripheral surface having a center axis fixed with respect to said support member and is rotatable about said center axis, the respective center axis of the rigid members being substantially aligned with each other and substantially parallel with said axis of said cam rollers, each of the cam rollers being in rollable contact with said cylindrical outer peripheral surface of said rigid members.

* * * * *